United States Patent [19]

Kadota

[11] Patent Number: 4,724,808

[45] Date of Patent: Feb. 16, 1988

[54] IDLE REVOLUTION CONTROL DEVICE FOR INTERNAL COMBUSTION ENGINE

[75] Inventor: Youichi Kadota, Hyogo, Japan

[73] Assignee: Mitsubishi Denki Kabushiki Kaisha, Tokyo, Japan

[21] Appl. No.: 47,343

[22] Filed: May 8, 1987

[30] Foreign Application Priority Data

May 8, 1986 [JP] Japan ..... 61-105413

[51] Int. Cl.[4] ..... F02D 41/06

[52] U.S. Cl. ..... 123/339; 123/362; 123/588

[58] Field of Search ..... 123/339, 362, 588

[56] References Cited

U.S. PATENT DOCUMENTS 3,964,457 6/1976 Coscia ..... 123/339

4,191,051 3/1980 Kawata et al. ..... 123/339

4,381,746 5/1983 Miyagi et al. ..... 123/339

*Primary Examiner*—Andrew M. Dolinar

*Attorney, Agent, or Firm*—Sughrue, Mion, Zinn, Macpeak and Seas

[57] ABSTRACT

An idle revolution control device includes a water temperature sensor, a filter means and a control means which is constituted with a central processing unit and an interface connecting the water temperature sensor and the central processing unit. The filter means functions to provide a time constant which provide a high response speed for a temperature variation toward a high temperature side and a low response speed for a temperature variation toward a low temperature side and to pass an output signal of the water temperature sensor with such time constant a predetermined time after an engine starts.

3 Claims, 9 Drawing Figures

SENSOR CONDITION
NORMAL
DISCONECT
V1
V3
V4
DISCONNECTION DETERMINATION LEVEL
V2 (CONVENTIONAL)
LOW TEMP.
V2 (PRESENT)

NORMAL
TEMPORAL DISCONECT
V5
V6

CHATTER

IDLE REVOLUTION CONTROL DEVICE FOR INTERNAL COMBUSTION ENGINE

BACKGROUND OF THE INVENTION

The present invention relates to an idle revolution control device for an internal combustion engine, in which the revolution of the engine at an idling condition is controlled to a predetermined value according to a temperature of an engine coolant.

A typical example of such idle revolution control device is shown in FIG. 1, in which reference numerals 1, 2, 3, 4, 5, 6 and 8 depict an internal combustion engine, a thermister as a water temperature sensor for detecting a coolant temperature of the engine 1 and providing an electric signal representative of the temperature, an engine revolution sensor for detecting the number of revolutions of the engine 1, a throttle valve provided in an intake pipe for controlling an amount of intake air, an idle switch for detecting a full closure of the throttle valve 4, i.e., an idling condition, a control device including a CPU 7 and a water temperature sensor interface 9 and an actuator provided in a bypass conduit bypassing the throttle valve 4, respectively.

The CPU 7 of the control device 6 receives outputs from the water temperature sensor 2, the revolution sensor 3 and the idle switch 5 to drive the actuator 8 according to these informations to cause it to regulate air flow through the bypass conduit to thereby control the idle revolution of the engine 1. The water temperature sensor interface 9 comprises a voltage dividing resistor $R_1$ for converting an output resistance of the thermister 2 into an analog voltage and a series connection of a resistor $R_2$ and a capacitor $C_1$ which constitute a primary filter for noise removal. An input voltage from the thermister 2 to the control device 6, an input voltage to the CPU 7 and a source voltage are depicted by $V_1$, $V_2$ and $V_3$, respectively.

In operation, an engine water temperature information from the thermister 2 and the output of the idle switch 5 are supplied to the CPU 7. When the CPU 7 confirms, according to the signal from the idle switch 5, that the engine 1 is idling, it calculates a desired revolution number of the engine on the basis of the information from the thermister 2 and a known relation between the information and the desired revolution number which is shown in FIG. 3, compares the desired revolution with an actual revolution number detected by the revolution sensor 3 and provides a drive signal which is supplied to the actuator 8. The actuator 8 responds to the drive signal to regulate the amount of air flowing through the bypass conduit so that a difference between the calculated value and the actual value is minimized. Thus the idling revolution is controlled. The controlled idling revolution is detected again by the revolution sensor 3 and by repeating this operation, the idling revolution number is finally controlled to a predetermined value.

It has been known practially, however, that there is a tendency of temporal disconnection or intermittent disconnection, i.e., chattering, between the thermister and the control device 6 due to undesired vibratioan or shocks of a vehicle equipped with them. FIGS. 2A to 2C illustrate voltage waveforms at various portions of the control device when such temporal disconnection and chattering between the thermister 2 and the control device 6. When the thermister 2 is completely disconnected from the control device 6 as shown in FIG. 2A, the input voltage $V_1$ to the control device 6 abruptly rises from a thermister output voltage $V_4$ to the battery voltage $V_3$. At this time, the resister $R_1$ serves as a pull-up resister which also serves to fix the voltage at the disconnection. Further, the input voltage $V_2$ to the CPU 7 rises also gradually to the battery voltage $V_3$ with a rising rate being determined by the time constant of the $R_2$ $C_1$ circuit and, when the input voltage $V_2$ to the CPU 7 becomes higher than a predetermined value set to discriminate the disconnection, the CPU 7 controls the fuel injection regardless of the information from the water temperature sensor to an extent that a reckless operation of the engine is restricted.

When the temperature sensor 2 is disconnected temporarily from the control device 6 as shown in FIG. 2B, the input voltage $V_1$ to the control device 6 rises abruptly from $V_4$ to $V_3$ and then falls to $V_4$. The input voltage $V_2$ to the CPU 7 rises toward $V_3$ and, when the disconnection is terminated, starts to fall to $V_4$ with a falling rate being determined by the time constant $C_1R_2$ which is usually several milliseconds.

Considering the fuel economy, it is ideal that the idling revolution of the engine is minimum at which the engine can rotate smoothly at a given temperature. Therefore, it has been usual that the desired revolution decreases with increase of the coolant temperature, as shown in FIG. 3. Further, since the resistance of the thermister 2 decreases with increase of temperature, both the input voltages $V_1$ and $V_2$ are low at high temperature and high at low temperature. Therefore, when a normal output voltage of the thermister 2 is $V_4$, the input voltage $V_2$ changes from $V_4$ through $V_5$, $V_3$ and $V_5$ to $V_4$.

For this reason, the desired revolution which should be $N_1$ becomes $N_2$ corresponding to $V_5$, which is too high.

In the case of the chattering as shown in FIG. 2C, the input voltage $V_2$ vibrates between the normal voltage $V_4$ and the battery voltage $V_3$. Assuming 50% duty cycle chattering, the input voltage $V_2$ may be astringent to an intermedial value between $V_4$ and $V_3$. Therefore, by changing the duty cycle suitably, it is possible to set the input voltage $V_2$ to an arbitary value between $V_3$ and $V_4$ and so the desired revolution of the engine 1 is selected in a range from $N_1$ to an upper limit of control.

As mentioned, various signals corresponding to abnormal conditions which do not correspond to water temperature are sent to the CPU 7 when the thermister 2 is disconnected temporarily or intermittently from the control device 6 and, when the CPU 7 responds to all of such signals, a range of the desired revolution of the engine becomes wide enough to cover all control range and, for some extreme case, the engine revolution rises abnormally.

SUMMARY OF THE INVENTION

An object of the present invention is to provide an idle revolution control device for an internal combustion engine by which the engine revolution does not rise abnormally even if the connection of the water temperature sensor and the control device is broken temporarily or intermittently.

The idle revolution control device according to the present invention is featured by supplying at a predetermined time after an engine is started, a signal of the water temperature sensor through a filter having a time constant which is large when the signal varies toward a low temperature side and is small when it varies toward a high temperature side.

In the present invention, the filter which is provided as one of functions of a CPU functions to restrict an abnormal level variation of the signal from the water temperature sensor to a level on a low temperature side when the signal disappears temporarily. Therefore, the CPU of the control device does not control the desired revolution to shift it abnormally high. Further, since, in the chattering situation, there is no substantial reduction of the signal voltage from the normal value, the desired revolution does not increase substantially and, when the connection is recovered from the chattering, the desired revolution is recovered immediately stably.

DETAILED DESCRIPTION OF THE PREFERRED EMBODIMENT

Figure 1:
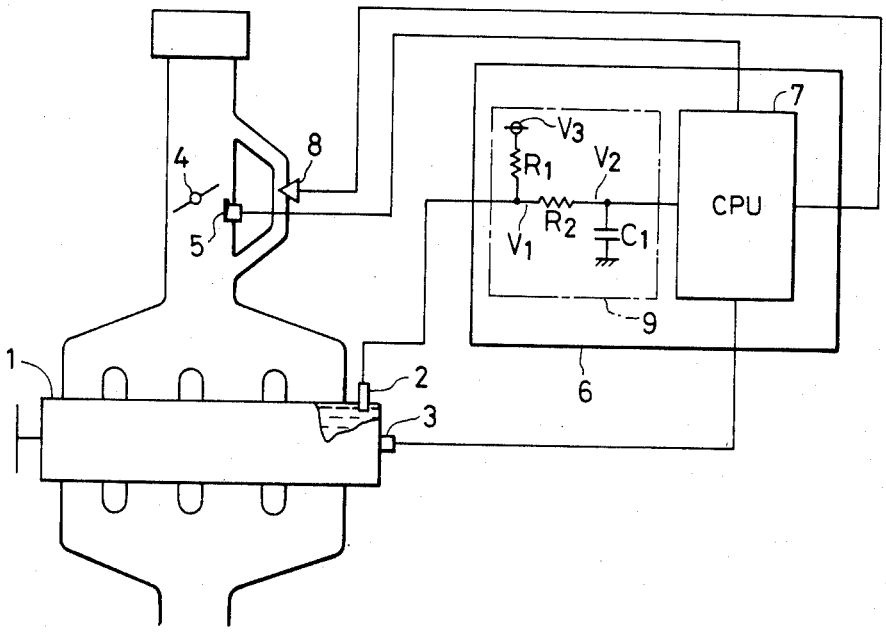
FIG. 1 is a schematic block diagram of a conventional idle revolution control device, which also shows schematically an embodiment of the present invention.

A construction of the present idle revolution control device is substantially the same as that shown in FIG. 1, when given as a block diagram. A feature of the present invention is a processing of an output signal of a thermister used as the water temperature sensor, which is to be performed in a CPU 7 of the control device 6. That is, in the present invention, a filtering function providing a time constant of several tens milliseconds for a temperature variation toward high temperature side and several milliseconds for a temperature variation toward low temperature side is produced by the CPU 7 so that the output signal from the thermister 2 is processed in the CPU 7 to give a time delay between a supply of the output signal from the thermister 2 and an engine start time.

Figure 2:
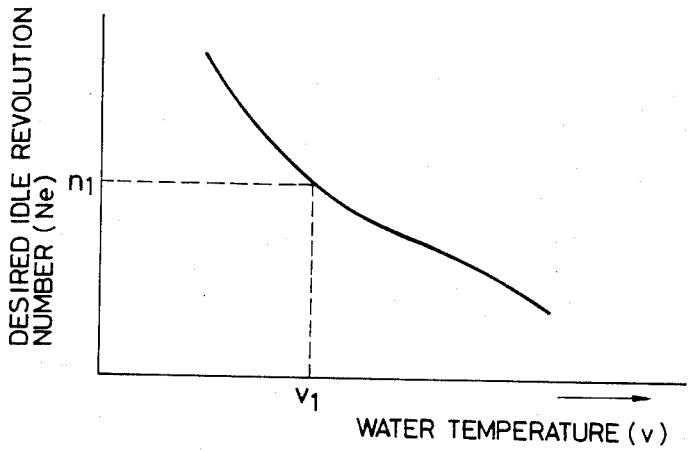
FIG. 2 is a graph schematically illustrating a relation between coolant water temperature and desired engine idling revolution.
Figure 3:
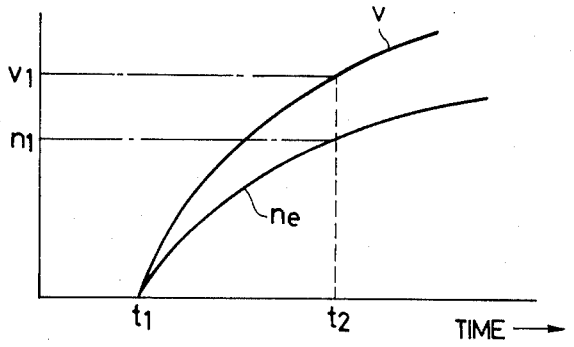
FIG. 3 is a graph schematically illustrating a filtering when it is performed without time delay.

That is, at a time when the power switch is turned on, the filter processes an output data (instantaneous value) of the water temperature sensor after an initialization of the CPU 7. Describing this in more detail, the desired idle revolution number of the engine is set at the lowest possible value at which the engine is still operable by taking the fuel economy and the drivability of the automobile into consideration and it is determined according to the water temperature vs. idling revolution number relation such as shown in FIG. 2. When the filtering operation of the water temperature data is started at the engine start time $t_1$, the desired revolution $n_e$ varies as shown in FIG. 3 due to the existence of the filter function and reaches the desired value $n_1$ corresponding to the actual water temperature at a time instant $t_2$. Therefore, there is a time delay $t_1-t_2$ which is usually several seconds.

Figure 4:
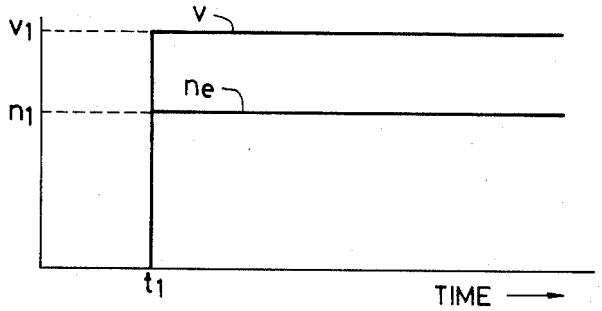
FIG. 4 is a graph schematically illustrating the filtering with a time delay.

On the other hand, when the filtering operation is performed after a predetermined time from the time at which the engine starts to revolute, i.e., when the filtering operation is performed with the value $n_e$ being set to the water temperature data at the time when the power is turned on, there is no such delay as shown in FIG. 4.

Under the condition shown in FIG. 3 in which the engine must operate at a speed lower than the desired speed for a relatively long time, the engine operation is necessarily unstable and tends to stop.

Figure 5:
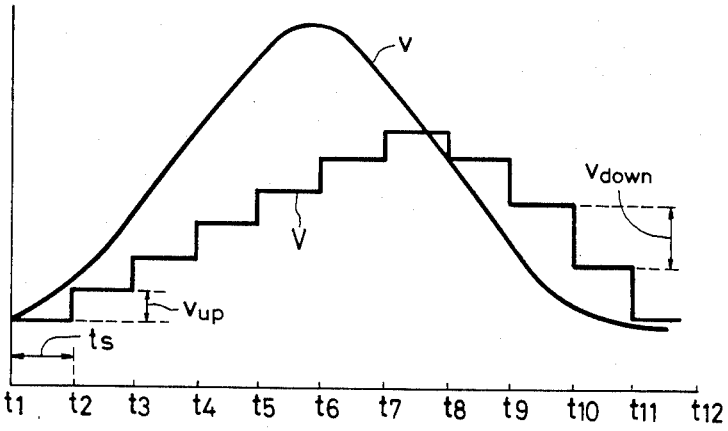
FIG. 5 illustrates a filtering function according to the present invention.

According to the present invention, the CPU 7 samples an output signal v of the water temperature 2 at a fixed period $t_s$ as shown in FIG. 5. In the CPU 7, when the output $v_{tn}$ of the water temperature sensor 2 at a time instance $t_{(n)}$ is equal to or larger than a sampled value $v_{t(n)}$ by a constant value $v_{up}$, which corresponds to a time period from $t_1$ to $t_7$ in FIG. 5, it is decided as $V_{t(n)}=V_{t(n-1)}+v_{up}$ to clip an amount of temperature increase to $v_{up}$. When the output $v_{t(n)}$ is equal to or smaller than $V_{t(n-1)}$ by a constant value $v_{down}$, which corresponds to a time period from $t_9$ to $t_{11}$ in FIG. 5, it is decided as $V_{t(n)}=V_{t(n-1)}-v_{down}$ to clip an amount of temperature decrease to $v_{down}$. When $v_{t(n)}-V_{t(n-1)}<v_{up}$ or $V_{t(n-1)}-vt_{(n)}<v_{down}$, which corresponds to time period $t_8$ and $t_{12}$ in FIG. 5, it is decided as $V_{t(n)}=v_{t(n)}$ to employ the data from the water temperature as it is.

Figures 6A, 6B, 6C:
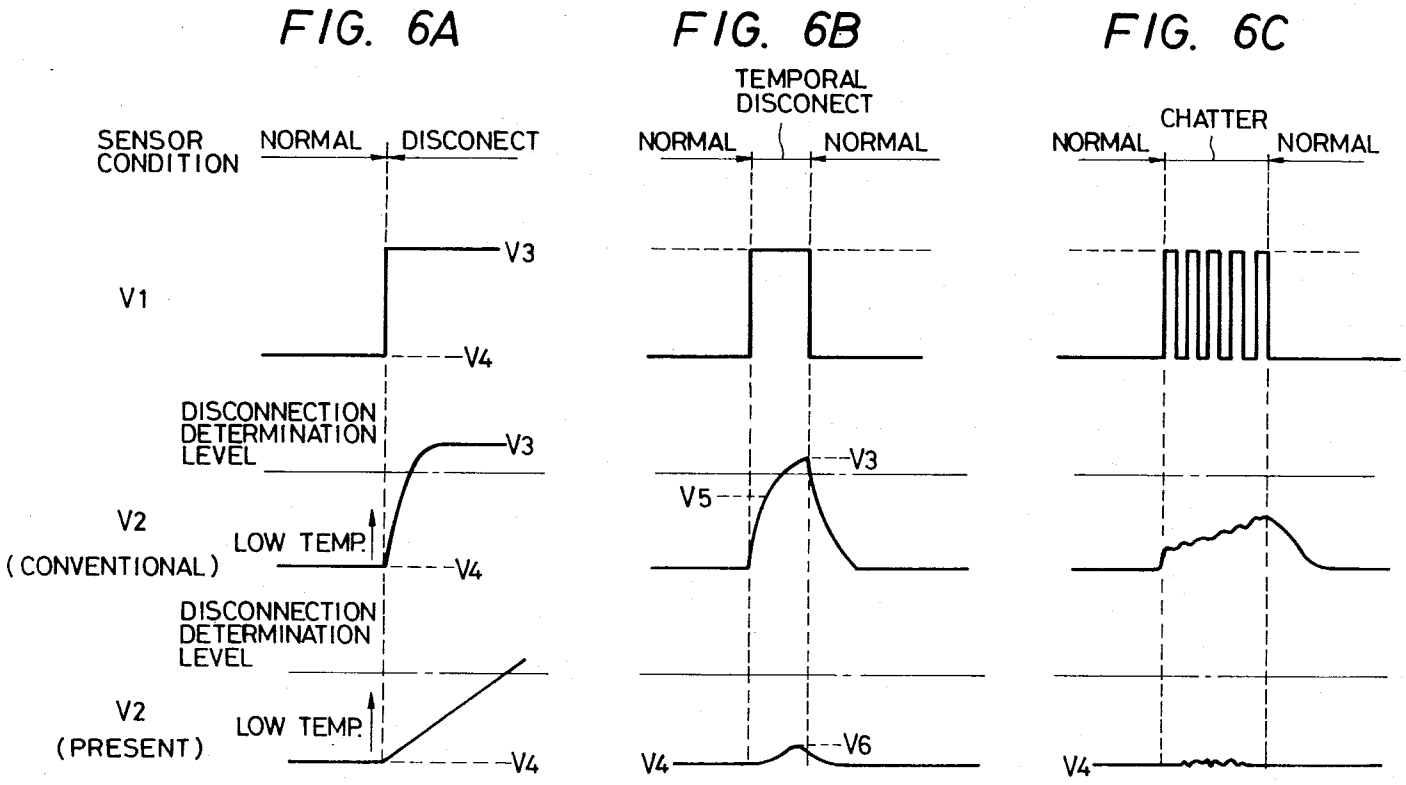
FIGS. 6A, 6B and 6C are voltage waveforms at various points of the control device when a water temperature sensor is disconnected from the control device permanently, temporarily and intermittently, respectively.

With such filtering function according to the present invention, when the detection signal from the thermister 2 disappeared as shown in FIG. 6A, the voltage $V_2$ at the input of the CPU 7 rises from the normal value $V_4$ at a rate determined by the time constant $R_2C_1$ and the time constant provided by the filtering function of the CPU 7. When the input voltage of the CPU 7 exceeds a disconnection determining level, the CPU controls the revolution on the fail-safe side regardless of the water temperature.

Figure 7:
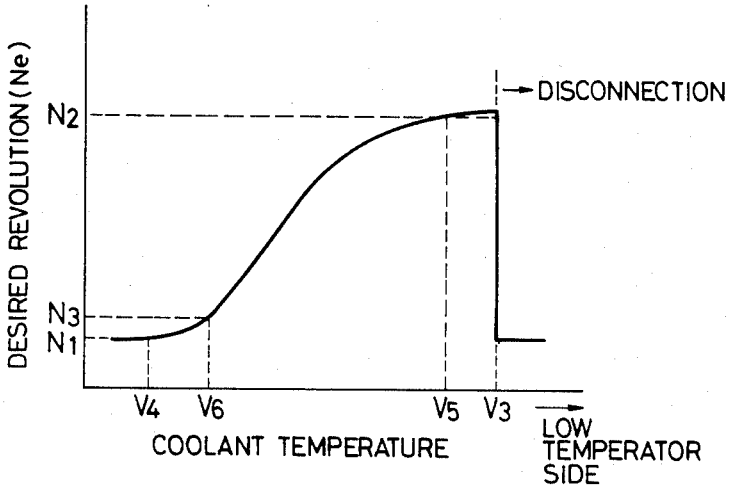
FIG. 7 is a graph showing a relation between engine coolant temperature and desired engine revolution.

When the thermister 2 is disconnected tempolarily as shown in FIG. 6B, the input voltage of the CPU 7 rises only to a small value $V_6$ and thus the desired revolution is allowed to rise to $N_3$ as shown in FIG. 7.

When the thermister 2 is disconnected intermittently, i.e., in the chattering state, as shown in FIG. 6C, the rise of the input voltage of the CPU 7 is very small, eliminating an abnormal increase of the desired revolution.

Since the filtering function of the CPU 7 provides a very rapid lowering of the input voltage, the input voltage of the CPU is recovered to the normal voltage $V_4$ immediately after the instantaneous or intermittent disconnection of the thermister 2 is removed and thus the engine revolution is returned to the desired revolution number $N_1$ and the engine can operate at the speed stably.

As mentioned hereinbefore, according to the present invention in which the output signal from the water temperature sensor is supplied after a predetermined time from the engine start time through the filter having time constants which provide a high response speed for a temperature variation toward the low temperature side and a low response speed for a temperature variation toward the high temperature side to the control means, there is no abnormal increase in the engine rotation in the case of the instantaneous or intermittent disconnection of the water temperature sensor and the engine speed can be recovered to the normal value immediately after the disconnection condition is removed.

What is claimed is:

1. An idle revolution control device for an internal combustion engine comprising a water temperature sensor for detecting temperature of an engine coolant to provide an electric signal indicative of the temperature, a filter means connected to an output of said water temperature sensor, said filter means having a filter function for passing said output signal of said water temperature sensor a predetermined time after the engine starts, with time constants providing a high response speed for a temperature variation toward a high temperature side and a low response speed for a temperature variation toward a low temperature side, and a control means responsive to an output signal of said filter means for controlling an idling engine revolution to a desired revolution number for a detected water temperature.

2. The idle revolution control device as claimed in claim 1, wherein said water temperature sensor is a thermister.

3. The idle revolution control device as claimed in claim 2, wherein said control means includes a central processing unit and an interface connecting said thermister and said central processing unit and wherein said filter means is provided by said central processing unit.

* * * * *